FIP7811 XR 3,951,458

United States Patent [19]

Cathles et al.

[11] 3,951,458

[45] Apr. 20, 1976

[54] METHOD OF EXPLOSIVE FRACTURING OF A FORMATION AT DEPTH

[75] Inventors: Lawrence Maclagan Cathles, Boston; Robert Amos Hard, Still River, both of Mass.

[73] Assignee: Kennecott Copper Corporation, New York, N.Y.

[22] Filed: July 31, 1974

[21] Appl. No.: 493,245

[52] U.S. Cl. ..... 299/5; 299/13

[51] Int. Cl.[2] ..... E21B 43/26; E21B 43/27; E21B 43/28

[58] Field of Search ..... 299/3–5, 299/13; 166/299, 247, 63, 308; 102/21, 23

[56] References Cited

UNITED STATES PATENTS

| | | | |
|---|---|---|---|
| 2,676,662 | 4/1954 | Ritzman | 166/299 |
| 3,565,173 | 2/1971 | Anderson | 166/299 X |
| 3,822,916 | 7/1974 | Jacoby | 299/4 |
| 3,841,705 | 10/1974 | Girard et al. | 299/4 |

*Primary Examiner*—Stephen J. Novosad

[57] ABSTRACT

This invention pertains to recovery of metal values from ore deposits found at great depth; more specifically, the invention pertains to the recovery of metal values from an ore deposit by explosive fracturing of the ore formation at a depth at which the deposit is economically inaccessible by surface mining. Still further, this invention pertains to a method for explosive fracturing of a formation containing metal values at depth whereby hydraulically assisted fracturing is used to propagate an explosive shock wave so as to obtain a more desirable medium in which metal value recovery can be practiced.

8 Claims, No Drawings

METHOD OF EXPLOSIVE FRACTURING OF A FORMATION AT DEPTH

BRIEF DESCRIPTION OF THE BACKGROUND FOR THE INVENTION

In the recovery of metals, such as copper, in general, two techniques have been widely practiced. One is an open pit mining technique which is well known in the Western United States. Another is conventional underground mining techniques of various subcharacterizations. These two techniques tend to maximize the available ore recovery at the least expenditure of unnecessary energy. However, various constraints such as waste disposal problems have made these methods more expensive. Still further, increasing capital requirements and less rich ores make underground mining increasingly expensive. Moreover, it has become increasingly more difficult to be assured of an economic return when mining copper deposits by underground mining techniques, because the cost for sinking a shaft and developing the necessary tunnels to reach the available ore bodies have been increasing at a rate greater than a projected recovery of the metal. As a consequence, it has become increasingly harder to justify an investment in underground mining for the development of ore bodies. Still further, at the great depth at which metal ore bodies such as copper ore bodies are found or have been found and not yet exploited, it has become more costly to sink the necessary shaft and provide the tunnels to economically recover the metals, such as copper metal.

Still further, the recovery of the copper ore body by underground tunneling is subject to a further high risk, because the exact boundaries of the ore deposits have often not been ascertained with a degree of certainty which would provide assurance of the total recoverable potential of metal in the ore body.

BRIEF OUTLINE OF THE INVENTION

It has now been found that the recovery of the metal values from ore bodies containing deposits of the basic metal therein can be practiced with an increased degree of success when employing what is known as an "in situ" mining technique. According to this technique, the ore body is worked by sinking a number of conventional drill holes in the ore formation, then fracturing the ore body, casing and sealing, if necessary, the wellbore and then leaching the fractured formation. Leaching of the formation is accomplished as illustrated by a number of companion U.S. Pat. Nos. 3,841,705, issued Oct. 15, 1974; 3,910,636, issued Oct. 7, 1975; 3,865,435, issued Feb. 11, 1975; 3,917,345, issued Nov. 4, 1975; and 3,881,774, issued May 6, 1975.

In these applications various aspects of in-situ mining techniques and improvements thereof have been shown, as well as an integrated recovery scheme directed to an in-situ mining operation with recovery methods of the dilute solutions.

In leaching, the injected leach solution or lixiviant flows primarily through fractures or open cracks in the rock formation being leached. Chemicals and metal values diffuse in and out of the mineralized rock between fractures where the lixiviant flows. Both the separation between fractures and the openness of the fracture (degree of impedance they offer to fluid flow) are important parameters affecting in-situ leaching.

New fractures, closer together, can be produced by explosively fracturing the formation. In addition, explosive treatment of the formation can make old fractures more open and less resistant to fluid flow. The present invention is related to a particular method of explosive treatment that is applicable in the treatment of deep deposits.

In particular, the present invention is directed to an aspect of the invention which pertains to the maximizing of the explosive effect in an in-situ recovery process by fracturing of the substantially impervious ore body (substantially impervious is defined to be less than 5.0 millidarcys).

It is desirable that much of the explosive energy be spent in breaking the rock into large particles, i.e. a coarse breaking (~3cm), or in increasing the permeability (openness) of preexisting fractures (cracks) in the rock formation. Little energy should be wasted in pulverizing the rock near the explosive charge.

On the surface these criteria are commonly achieved by detonating the explosive charges near an open face. In the near surface environment, if the formation is water saturated, it has been shown that water-filled fractures tend to act, under the impulse of the explosive pressure wave, as relatively frictionless planes. The explosive charge then causes, in a water saturated near surface (<1500′ of depth) environment, primarily a rotation of ore blocks bordered by such frictionless fracture planes. Such rotation causes both a breaking up of the fracture bordered blocks and an opening of the preexisting fracture. Pulverization near the explosive charge is minimized.

Below about 2000′ depth, however, the fractured planes are pushed together so strongly by the weight of the overlying rock, that these planes have considerable strength due to the frictional contact of the rock faces. Explosive charges at depths greater than 1500′ primarily pulverize the rock near the explosive charge.

It is the objective of the present invention to reclaim the advantages of the near surface environment by prepressurizing the environment at depths below about 1500′ by forcibly injecting fluid (water) under pressure into drill holes in the neighborhood of the hole to be explosively treated. The fluid or water can be injected at greater than lithostatic pressure or less depending on the effects desired. The prepressurization will have two effects:

1. It will cause the water-filled fracture planes once again (or as in the near surface environment) to become relatively frictionless planes of contact upon incidence of the explosive pressure pulse.

2. As a result of increasing the fluid pressure in the pores of the rock, the rock formation becomes more brittle and less ductile.

For the above two reasons, pulverization near the explosive charge will be minimized, and coarse (~3 cm) scale fracturing and opening of preexisting fracture planes will be promoted.

BRIEF DESCRIPTION OF THE PRIOR ART

In shallow ore deposits, water has been suggested as a means for keeping apart the pressure points of the fractures or planes dispersed in the ore body. When explosive force is acting on the ore body only the pressure points are affected when the deposits are displaced.

DETAILED DESCRIPTION OF THE INVENTION

It has now been found that water filled fractures of drill holes have a tendency to seal under a lithostatic pressure corresponding to 1500′ or more of overburden, and accordingly, the effective explosive fracturing of the deep ore bodies becomes extremely difficult.

When the lithostatic pressure associated with an overburden depth of 1500′ or more are encountered, the great depth of overburden makes the recovery of metal values such as copper more difficult for the above mentioned economic reasons by the conventional mining techniques. Additionally, when practicing the in-situ method of recovery, it has been found necessary that a degree of rubblization (which is defined as the necessary fracturing of the ore body with a degree of fineness to allow sufficient fast leaching of each fracture block) must be achieved in order to make the process operative.

Accordingly, by the present method, it has been discovered that prepressurizing the bore hole for a period of from about 2 hours to 2 days or more so that the deep lying pyrophyry copper deposits can be effectively stimulated by explosive fracturing at these depths allows the obtaining of the necessary degree of rubblization required for a given rate of in-situ copper recovery with a defined diffusion control of the leaching rate. In accordance with this invention, an important aspect of the method is to achieve optimum alternations of the formation from a given amount of explosive placed at a bottom of a wellbore or a system of wellbores.

According to the present invention, it has been discovered that the use of hydraulic over-pressure in combination with typical explosives that can be detonated at a pressure over 1000 psi, provides for explosive stimulation of in-situ mining independent of the depth below 1500′ despite the various factors which have prevented the stimulation in the past such as because of the increasing rock pressure.

Thus, in accordance with the present invention, it has now become possible to improve the explosive wellbore stimulation by hydraulically overpressurizing the space adjacent to the drill hole and appropriately to rubblize the rock formation, whereby the leaching efficiency is significantly enhanced over that achieved by conventional explosive fracturing.

In accordance with the invention, the explosive is placed in the wellbore at depths desired for the fracturing of the ore formation. After the explosive charges are in place, hydraulic pressure between half the overburden pressure and the full overburden pressure is produced in the wellbore and held at this valve for a specified period of time. The lower limit of the time range depends on the relative porosity and permeability of the ore formation and density. The time of pressurization may range from as little as ten minutes to up to 48 or more hours for a less permeable porous formation. Within these two time limits, substantially all of the rock formations with which copper deposits are associated are fractured when practicing the present invention.

In general, a convenient yardstick is an overpressure maintained in the wellbore at the desired depth for at least one hour and up to ten hours. This time period in conjunction with the indicated pressure will produce the necessary increase in stimulation when the explosive will be set off.

As suitable explosives, the following have been used: stabilized nitroglycerin and water gels such as DuPont's Tovex 550 and Hercules HP 196. Other explosives suitable for detonation under water and high pressure are listed in *Reigel's Handbook of Industrial Chemistry*, 7th ed., Van Nostrand Reinhold Co., 1974, pages 570 to 578.

As mentioned before, the important aspect of the present invention is the maintenance of the hydraulic overpressure in the wellbore. This pressure must be superimposed on the wellbore such that the pressure is held for a minimum of time estimated or determined from the core analysis. Core analysis indicates factors such as permeability and other properties of the ore deposit. Additional factors are pressure drop in a pressurized well or other like conditions.

In accordance with this invention, the pressure of the water in the rock pores throughout the formation in the vicinity of the wellbore will be increased above the normal hydrostatic head before the shock wave is produced.

In another aspect of the invention, it has been discovered that the placing of the explosive in the wellbore adjacent to one near which a high pressure is induced is also conducive to the increased stimulation of the formation. According to this aspect of the invention, an appreciable increase in pore pressure of the rock on one side of the charge is subject to stimulation and thus an asymmetrical effect of a stimulation is achieved. In accordance, large scale shear along pre-existing fluid fracture planes is encouraged and improved permeability results. In addition, the present invention is applicable not only to a wellbore, but also multiwellbore systems.

Still further, the second aspect which has resulted from the present invention is the increased brittleness of the matrix of the unfractured material by virtue of the increased fluid pressure. As a consequence of the increased brittleness of the formation, a green explosive charge will produce a finer degree of rubblization of the formation. treated, and thereby smaller ore blocks with greater leachability.

In accordance with the present invention, the following embodiment is set forth to illustrate the practice of the invention in the overall in-situ recovery of the copper ore.

A 10 cm. hole is drilled to a depth of 1800′ in a primary copper ore body. Another hole used for monitoring is located about 50′ away. Permeability measurements are made by packing off the lower 100′ of the first hole and flowing water under pressure. Calculations from the pressure and flow rate shows the native permeability as about 0.05 md. (millidarcys).

Approximately 1000 lbs. of a typical commercial water gel explosive, e.g. Hercules HP 196, is then placed in the hole and is then stemmed with water and detonated. After clean out, the wellbore radius is found to be about 24 cm. and the permeability increased to about 1 md. as judged by a water flow test. The permeability of the monitor hole is not significantly increased.

The above test is repeated in a new hole of about 1800′ and similar type drilled 300′ away from the original hole, except that before detonating the explosive, it is stemmed with water, and pressurized to 400 psi at the surface for a period of 5 hours. After this time, the explosive is detonated and subsequent water tests shows the permeability is increased from 0.05 to 5.0 md. In addition, the permeability of the monitor hole is increased by 100%.

Another embodiment is illustrated herein and places the present invention in its proper context.

An ore body 100 acres in area and averaging 1000′ in thickness lies at an average depth of 4,000′ below the surface of the earth near Safford, Arizona. Samples of the ore show that it is composed primarily of granitic igneous rock and that it contains chalcopyrite as the principal copper mineral. The ore samples also show that it contains approximately 1.4 weight percent chalcopyrite and that the total copper content of the ore averages 0.5 percent. The volume of ore in the deposit is, therefore $10^4$ percent acre-feet or $4.356 \times 10^8$ cubic feet. The specific gravity of the granitic ore is 2.6. Therefore, the total weight of the ore in the deposit is $3.54 \times 10^7$ tons, and the copper content of the ore body is $3.54 \times 10^8$ pounds.

Approximately 50 wells are drilled into the ore body in an array such as to provide a five-spot pattern, and the wells are completed such that fluids may be either injected or produced from individual wells. By measurements on core samples and by injection and production tests on individual wells, it is determined that the void volume within the randomly-oriented fracture system is equivalent to 2 percent of the bulk ore volume, that the fracture spacing averages 6 inches, and that the permeability of the ore body to liquid averages less than about 2 millidarcys. This permeability is less than desired for economic recovery of copper.

Petrographic examination of core samples taken from the ore body shows that about 2 percent of the rock surface area exposed by the fractures is covered by the chalcopyrite mineral and that the rock matrix bounded by the fracture system is substantially cubical in configuration.

Thus, the surface-to-volume ratio of the ore bodies bounded by the fractures is approximately equal to that for cubically shaped blocks and the surface area to volume ratio for the ore blocks is equal to 6/L, where L is the length of the side of a cube. In this case L = 0.5 feet, and the surface area to volume ratio is equal to 12 square feet/cubic foot.

The total surface area of ore exposed by the fracture network is equal to $12 \times 4.36 \times 10^8$ or $5.227 \times 10^9$ square feet. The surface area of the chalcopyrite mineral exposed by the fracture system is equal to 2 percent of the total surface area, or $1.045 \times 10^8$ square feet.

Laboratory tests with the ore samples showed that ferric sulfate solutions will dissolve copper from the chalcopyrite of the ore body at a rate equal to 0.002 pound of copper per square foot of chalcopyrite surface area per day. The initial maximum rate of copper production attainable from the ore body by in-situ leaching with ferric sulfate would be $0.002 \times 1.045 \times 10^8 = 209{,}000$ pounds of copper per day. The laboratory tests also showed that by allowing a 0.4 molar solution of ferric sulfate to react completely with the chalcopyrite and other minerals in the ore, a pregnant leach solution containing 3.0 pounds of copper per barrel (42 gallons) could be obtained. Therefore, in order to supply 0.4 molar ferric sulfate solution to the ore body at the optimum rate; i.e., at the rate sufficient to produce the maximum amount of copper and at the same time allow total reaction of the ferric iron, the 0.4 molar ferric sulfate solution must be injected initially at a rate equal to 69,700 barrels/day. The required average residence time for the solution within the ore body is fixed by the injection rate and the void volume of the ore body:

$$\text{Average Residence time} = \frac{\text{void volume}}{\text{injection rate}}$$

$$= \frac{(0.02)\ (4.36 \times 10^8 \text{ cubic feet})}{(69{,}700 \text{ bbl./day})\ (5.615 \text{ cu. ft./bbl.})} = 22.3 \text{ days}$$

The injection and withdrawal rates of the wells are thus regulated to permit the ferric sulfate solution to remain in the ore body for approximately 22 days. Inasmuch as useable flow rate, i.e., injection rate, is proportional to pressure drop times permeability (and inasmuch as injection pressure should not exceed two-thirds parting pressure at maximum), any increase in flow rate as a result of an increased permeability will decrease the average residence time of the leaching fluid in the ore body.

Stated otherwise, from the formula above, it is evident that the permeability is a divisor and any increase in permeability provides a great per unit time increase in the amount of leaching liquid in the ore body. Thus, injection and withdrawal rates can be greatly increased.

When the initial deposit permeability is substantially below the 1–5 millidarcy economical range, it is evident that the permeability has a marked economic effect on the in-situ recovery of copper values.

While the embodiment above has been described as applicable to the copper sulfide ores, it should be understood that the process is also applicable to ores bearing native copper and also to ores of copper oxides and silicates where the copper is present in the cuprous valence state. When the copper is present in its elemental or lower valence state, it is susceptible to oxidation by ferric iron to form solutions of cupric sulfate.

With respect to the solution mining processes of copper, the present hydraulic fracturing method is applicable to oxygen-water lixiviant, oxygen-ammonia lixiviant and the above-illustrated ferric sulfate lixiviant systems.

It has also been found that if a surface active agent, (surface tension reducer) such as soaps, detergents, (e.g. alkylated monosodium benzene sulfonates), nonionic surface active agents, (e.g. Tween trademarked products) etc. are used in the wellbore overpressurizing step (before explosive fracturing), the overpressurizing step and thus the stimulation is further enhanced by the above permeation improving agents.

The normal hydrostatic pressure is about 435 psi for each 1000′ of water below the water table. Thus, the pressures employed for overpressurizing the hole are generally in excess of the hydrostatic pressure up to the overburden pressure including up to the parting pressure. However, as long as any excess pressure accomplishes the permeation of the zone sought to be affected by the explosive charge, the increase in overpressure tends to reduce the time for permeating the formation with the fluid.

The combination of time, pressure, and permeability of the formation also defines the space which is overpressurized with the fluid. Inasmuch as permeability can be established from field data and time and pressure controlled, the defined space is predetermined within a reasonable degree of accuracy for each formation.

What is claimed is:

1. A method for increasing the leaching efficiency of an ore body from which metal values are sought to be recovered adjacent to a drill hole, including introducing into a drill hole an explosive, the improvement comprising: filling a drill hole with a fluid such as water or a liquid, overpressuring the fluid to exceed the lithostatic pressure and to produce fractures from the hole into the formation; thereafter, while maintaining said pressure, detonating the explosive for creating a shock wave through the fractures, introducing a leaching fluid into said ore body and recovering same with leached metal values.

2. In a method for stimulation and solution mining of at least one wellbore at a depth greater than 1500′, said solution mining being an in-situ process for recovery of ore values from the stimulated wellbore whereby the wellbore is stimulated by an explosive fracturing, the improvement comprising introducing into a first wellbore an explosive, overpressurizing hydraulically an adjacent wellbore with a hydraulic pressure in excess of the hydrostatic pressure encountered in said adjacent wellbore, explosively fracturing the thus hydraulically over-pressurized adjacent wellbore after pressurization of the space in the surrounding ore deposit adjacent to the wellbore by exploding the explosive in the first wellbore.

3. In a method for stimulation and increasing a leaching efficiency in solution mining of at least one wellbore at a depth greater than 1500′, said solution mining being an in-situ process for recovery of ore values from the stimulated wellbore whereby the wellbore is stimulated by an explosive fracturing, the improvement comprising introducing into the wellbore the explosive, overpressurizing hydraulically the wellbore with a hydraulic pressure in excess of the hydrostatic pressure encountered in a wellbore and explosively fracturing the thus hydraulically over-pressurized wellbore after pressurization of the space in the surrounding ore deposit adjacent to the wellbore and in a preselected volume adjacent to the explosive charge, whereby increased permeability and coarse breaking of a rock formation adjacent to said wellbore is achieved.

4. The method as defined in claim 1, wherein the overpressurizing in the wellbore is maintained for a period from about 10 minutes to 24 hours, before detonation.

5. The method as defined in claim 3, wherein the wellbore, after the placement of the explosive is further treated with a surface active agent as a permeation improving agent which aids the hydrostatic overpressurization.

6. The process as defined in claim 3, wherein the wellbore is at a depth greater than 1500′ and where the explosive used is a water gel of stabilized nitroglycerin.

7. The method as defined in claim 3, and wherein ore values are metal values which are recovered from a stimulated wellbore.

8. The method as defined in claim 3, and wherein a ferric sulfate lixiviant system is used for recovering of copper values from a stimulated wellbore.

* * * * *